US005221135A

United States Patent [19]

Nakamura

[11] Patent Number: 5,221,135

[45] Date of Patent: Jun. 22, 1993

[54] PROTECTIVE COVER FOR TOOL BOX DRAWER HANDLE

[76] Inventor: Val H. Nakamura, 1542 Madrid Dr., Vista, Calif. 92083

[21] Appl. No.: 792,643

[22] Filed: Nov. 15, 1991

[51] Int. Cl.[5] ..... A47B 88/04

[52] U.S. Cl. ..... 312/348.6; 16/110 R

[58] Field of Search ..... 16/110 R, 114 R; 312/320, 348.6

[56] References Cited

U.S. PATENT DOCUMENTS

| | | | |
|---|---|---|---|
| 2,231,830 | 1/1941 | Moore et al. | 16/110 R |
| 4,090,756 | 5/1978 | Frey et al. | 312/320 |
| 4,090,757 | 5/1978 | Frey et al. | 312/320 |
| 4,846,042 | 7/1989 | Wetty | 16/110 R X |

*Primary Examiner*—Peter R. Brown
*Attorney, Agent, or Firm*—Calif Kip Tervo

[57] ABSTRACT

A protective cover for the handle of a tool box drawer of the type having a front wall; the front wall having a front face and a rear face and having a rearward slanting upper section terminating at an upper edge. The handle having sides and having a rear edge connected to the front wall upper edge, the handle projecting generally forward and downward such that it has a generally upward and forward facing top face and has a generally downward and rearward facing rear face and it forms a downward facing cavity forward of the front wall for insertion of fingers for opening the drawer. The protective cover includes a cover panel of strong hard material protectively covering the handle top face; a rear panel connected to the cover panel rear edge and projecting downward and forward to abut the drawer front wall rear face for preventing forward movement of the cover panel on the handle and for preventing upward movement of the rear of the cover panel on the handle; side panels connected to the cove panel sides and projecting downward adjacent the sides of the handle for preventing sideward movement of the cover panel on the handle and for preventing injury; and projections on the inside of the side panels to engage the handle rear face for preventing upward movement of the front of the cover panel on the handle.

8 Claims, 1 Drawing Sheet

PROTECTIVE COVER FOR TOOL BOX DRAWER HANDLE

BACKGROUND OF THE INVENTION

1. Field of the Invention

This invention relates in general to a protective cover for a drawer handle and more specifically involves a snap-on shielding cover for the drawer handle of a tool chest.

2. Background of the Invention

Typically, large tool chests, such as those used by craftsmen such as automobile mechanics, include a multiplicity of sliding drawers. A top surface is flat for using as a storage or working space. The tool chests are typically are made of light gauge steel and coated, such as with paint.

Typically, the drawer handles of the tool chest project forward from the upper edge of the front of the drawer and it is these drawer handles that receive the brunt of the damage from related activities. Tools being removed and replaced, sometimes not so gently, from the drawers dent the handles and chip the paint. Tools and parts falling off the top surface of the chest cause similar damage. Chemicals, such as solvents and brake fluid, spilled from the top working surface damage the handles by dissolving or discoloring the paint and/or the metal.

Therefore, it is desirable to have a protective cover that can be easily applied to tool chest drawer handles that will resist or prevent damage.

SUMMARY OF THE INVENTION

This invention is the combination of tool box drawer having a handle and a protective cover for the handle. A preferred embodiment of the invention generally comprises a tool box drawer and of the type having a front wall; the front wall having a front face and a rear face and having a rearward slanting upper section terminating at an upper edge.

The handle has sides and has a rear edge connected to the front wall upper edge. The handle projects generally forward and downward such that it has a generally upward and forward facing top face and has a generally downward and rearward facing rear face and it forms a downward facing cavity forward of the front wall for insertion of fingers for opening the drawer.

The protective cover includes a cover panel of strong hard material, such as brushed stainless steel, protectively covering the handle top face. A rear panel connected to the cover panel rear edge projects downward and forward to abut the drawer front wall rear face and prevents forward movement of the cover panel on the handle and prevents upward movement of the rear of the cover panel on the handle. Side panels connected to the cover panel sides project downward adjacent the sides of the handle and preventing sideward movement of the cover panel on the handle. Projections on the inside of the side panels to engage the handle rear face and prevent upward movement of the front of the cover panel on the handle.

Other features and many attendant advantages of the invention will become more apparent upon a reading of the following detailed description together with the drawings in which like reference numerals refer to like parts throughout.

DETAILED DESCRIPTION OF THE INVENTION

Figures 1, 2:
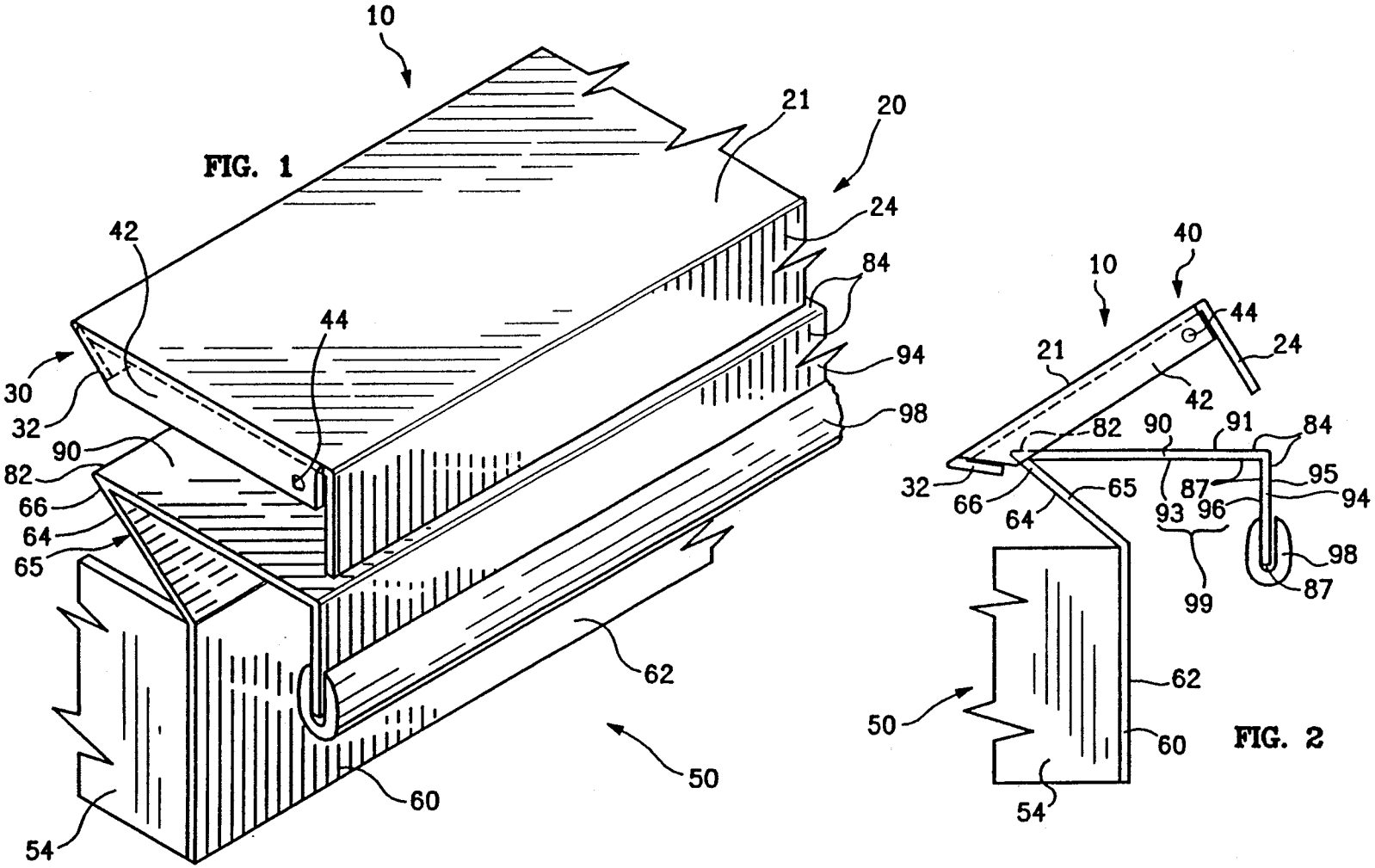
FIG. 1 is an exploded perspective view, partially cut away, of the a preferred embodiment of the handle cover of the invention as attached to a drawer of a tool chest.
FIG. 2 is a reduced a side view similar to FIG. 1 but with the protective cove in the process of being attached to the drawer handle.

With reference now to the drawings, there is shown a preferred embodiment of the tool box drawer handle protective cover, denoted generally as 10. FIG. 1 is an exploded perspective view, partially cut away, of the a preferred embodiment of the handle cover 10 of the invention as attached to a typical drawer, denoted generally as 50, of a tool chest. FIG. 2 is a reduced a side view similar to FIG. 1 but with the protective cover 10 in the process of being attached to the drawer handle, denoted generally as 80.

Drawer 50 is typically made of thin metal sheeting, such as of steel and includes side wall 54 and a front wall 60. Front wall 60 has a front face 62 and a rear face 64 and an upper edge 66. Drawer front face 62 generally covers the front opening to the drawer space in the tool chest.

Drawer handle 80 has a rear edge 82 connected to the front wall upper edge 66 From its rear edge 82, handle 80 projects generally forward and downward to form a downward facing cavity 99, as best seen in FIG. 2, forward of front wall 60 for insertion of fingers for pulling drawer 50 to the open position. Handle 80 has a top face 84 facing generally upward and forward and a bottom face 87 facing generally downward and rearward and, in the embodiment shown, includes the very end of downward projecting vertical section 94. In the embodiment shown, handle 80 includes a forward projecting horizontal section 90 having an outer end 92 and includes a downward projecting vertical section 94 connected at it top edge to the outer end 92 of horizontal section 90. A molding 98, such as of aluminum or alloy, is attached to the end of handle 80, such as to the lower end of vertical section 94. Molding 98 is typically clipped or crimped on to end of handle 80. Horizontal section 90 has an upward facing top face 91 and a downward facing bottom face 93 and vertical section has an forward facing fore face 95 and a rearward facing rear face 96.

In the preferred embodiment, drawer front wall 60 has an upper section 65 that slants rearward at the junction of upper end 66 with rear end 82 of handle 80.

The protective cover, denoted generally as 10, for handle 80 includes, in general, a cover panel, denoted generally as 20, a rear retaining means, denoted generally as 30, and a front retaining means, denoted generally as 40.

Cover panel 20 protectively covers the handle top face 84. In the embodiment shown, cover panel 20 comprises a horizontal section 21 and vertical section 24 for overlying the corresponding horizontal section 90 and vertical section 94 of handle 80. Vertical section 24 may extend downward to terminate above molding 98 or may extend further downward so as to fit behind molding 98.

Rear retaining means 30 is connected to the rear edge of cover panel 20 and includes a rear panel 32 that projects downward, and forward to contact the rearward slanting upper section 65 of drawer front panel 60. Preferably, rear panel 32 parallels upper section 65 and lies directly adjacent it. Rear panel 32 can be a continuous strip panel or may be smaller tabs. Rear panel 32 prevents forward movement of cover 20 and upward movement of the rear of cover 20.

Side restraining means, such as a pair of side panels 42, one attached to each side of cover 20, project downward for preventing sideward movement of cover 20 on handle 80. It is common to scratch or cut a leg or thigh by running into the side of an open drawer. Side panels 42 also help prevent injury to workers when an open drawer is accidentally struck from the side.

A front retaining mean 40 restrains the front portion of cover 20 from upward rotation and thereby keeps the cover in the protective position. In the embodiment shown, front retaining means 40 engages the handle bottom face 87 near the front end for preventing upward movement of the front end of cover panel 20 once it is in protective position and includes a resilient tab means, such as dimple punch 44, on the inside of side panels 42 for extending under the rear side of handle 80. Dimple punch 44 creates a small detent dome that will snap under handle 80 due to the resilience in side panel 42. In the embodiment shown, the resilient tabs 44 are located in the side restraining means but this need not be the case. An alternate front restraining means comprises extending vertical section 24 so as to be held behind molding 98.

As best seen in FIG. 2, cover 10 can be attached to handle 80 by "hinging" the rear portion including rear panel 32 over the rear edge 82 of handle 80 and rotating the front portion until dimple punch 44 clips under handle horizontal section 90.

Molding 98 can be opened to accept vertical cover section 24 and re-crimped if necessary. Molding 98 can also serve to retain the front of cover 20.

Cover 20 may be made of any suitable material that protects the handle. Brushed stainless steel is a preferred material because of its strength and non-corrosive qualities and also because it does not show minor scratches and markings.

Having described the invention, it can be seen that it provides a very convenient device for the protection of tool box drawer handles.

Although a particular embodiment of the invention has been illustrated and described, various changes may be made in the form, composition, construction, and arrangement of the parts without sacrificing any of its advantages. Therefore, it is to be understood that all matter herein is to be interpreted and illustrative and not in any limiting sense and it is intended to cover in the appended claims such modifications as come within the true spirit and scope of the invention.

I claim:

1. In combination with a drawer having a front wall; the front wall having a front face and a rear face and including an upper edge; and a handle including a main wall having a top face, a bottom face, a front edge and side edges and having a rear edge connected to the front wall upper edge, the handle defining a downward facing cavity forward of the front wall for insertion of fingers for opening the drawer; a protective cover for the drawer handle comprising:

a cover panel of strong hard material protectively covering the handle man wall top face; said cover panel including a planar main portion, a rear edge, a front edge and side edges;

rear retaining means connected to said cover panel rear edge and projecting downward past the handle main wall rear edge for preventing forward movement of said cover panel on the handle main wall; and front retaining means connected to a said side edge of said cover panel and projecting downward including a protrusion for engaging the handle main wall bottom face such that the front of said cover cannot move upward on the handle.

2. The combination of claim 1 wherein said cover further includes:

side restraining means connected to said cover panel side edges and projecting downward adjacent the side edges of the handle main wall for preventing sideward movement of said cover panel on the handle.

3. The combination of claim 1 wherein said cover further includes:

side panels connected to said cover panel side edges and projecting downward adjacent the side edges of the handle main wall for preventing sideward movement of said cover panel on the handle.

4. The combination of claim 1 wherein:

said front retaining means further includes:

resilient side panels connected to said cover panel side edges and projecting downward adjacent the side edges of the handle main wall and having an inside for bearing against the side edges of the handle main wall for preventing sideward movement of said cover panel on the handle; and wherein said front retaining means protrusion is disposed on the inside of a said side panel.

5. In combination with a drawer having a front wall; the front wall having a front face and a rear face and having a rearward slanting upper section terminating at an upper edge; and a handle including a main wall having a top face, a bottom face, a front edge and side edges and having a rear edge connected to the front wall upper edge, the handle defining a downward facing cavity forward of the front wall for insertion of fingers for opening the drawer; a protective cover for the drawer handle comprising:

a cover panel of strong hard material protectively covering the handle top face; said cover panel including a planar main portion, a rear edge, a front edge and side edges;

rear retaining means connected to said cover panel rear edge and projecting downward and forward to abut the drawer front wall rear face for preventing forward movement of said cover panel on the handle and for preventing upward movement of the rear of said cover panel on the handle; and front retaining means connected to a said side edge of said cover panel and projecting downward including a protrusion for engaging the handle main wall bottom face such that the front of said cover panel cannot move upward on the handle.

6. The combination of claim 5 wherein said cover further includes:

side restraining means connected to said cover panel side edges and projecting downward adjacent the side edges of the handle main wall for preventing sideward movement of said cover panel on the handle.

7. The combination of claim 5 wherein said cover further includes;

side panels connected to said cover panel side edges and projecting downward adjacent the side edges of the handle main wall for preventing sideward movement of said cover panel on the handle.

8. The combination of claim 5 wherein:

said front retaining means further includes:

resilient side panels connected to said cover panel side edges and projecting downward adjacent the side edges of the handle main wall and having an inside for bearing against the side edges of the handle main wall for preventing sideward movement of said cover panel on the handle; and wherein said front retaining means protrusion id disposed on the inside of a said side panel.

* * * * *